US005787505A

United States Patent [19]

Piwko et al.

[11] Patent Number: 5,787,505

[45] Date of Patent: Aug. 4, 1998

[54] COOLING AND/OR WARMING SHIRT

[76] Inventors: Margaret M. Piwko, 48 Shenandoah Rd., Buffalo, N.Y. 14220; James C. Simmons, 11 Falmouth La., Williamsville, N.Y. 14221

[21] Appl. No.: 795,553

[22] Filed: Feb. 6, 1997

Related U.S. Application Data

[60] Provisional application No. 60/011,304, Feb. 7, 1996, and provisional application No. 60/012,787, Mar. 4, 1996.

[51] Int. Cl.[6] ..... A41D 1/04

[52] U.S. Cl. ..... 2/115; 2/94; 2/247

[58] Field of Search ..... 2/102, 94, 69, 2/247, 7, 115, 251, 81, 51, 114, 106; 607/108, 109, 110; 62/259.3

[56] References Cited

U.S. PATENT DOCUMENTS

| | | | |
|---|---|---|---|
| 2,403,676 | 7/1946 | Modinski | 2/94 |
| 2,566,533 | 9/1951 | Poux . | |
| 3,717,145 | 2/1973 | Berndt et al. . | |
| 3,950,789 | 4/1976 | Konz et al. | 2/97 |
| 4,005,494 | 2/1977 | Burn . | |
| 4,601,067 | 7/1986 | Buonassissi | 2/94 |
| 4,641,655 | 2/1987 | Abt . | |
| 4,688,572 | 8/1987 | Hubbard et al. . | |
| 4,776,042 | 10/1988 | Hanson et al. . | |
| 4,805,619 | 2/1989 | Swearingen . | |
| 4,805,620 | 2/1989 | Meistrell . | |
| 4,931,333 | 6/1990 | Henry . | |
| 5,005,374 | 4/1991 | Spitler | 62/259.3 |
| 5,016,629 | 5/1991 | Kanare . | |
| 5,031,244 | 7/1991 | Inagaki | 2/94 |
| 5,038,779 | 8/1991 | Barry et al. | 2/102 |
| 5,069,208 | 12/1991 | Noppel et al. . | |
| 5,072,455 | 12/1991 | St. Ours | 2/102 |
| 5,133,348 | 7/1992 | Mayn . | |
| 5,150,707 | 9/1992 | Anderson | 128/402 |
| 5,305,471 | 4/1994 | Steele et al. | 2/102 |
| 5,415,222 | 5/1995 | Colvin et al. | 2/102 |
| 5,424,519 | 6/1995 | Salee . | |
| 5,524,293 | 6/1996 | Kung | 2/102 |
| 5,606,746 | 3/1997 | Shelton et al. | 2/94 |

OTHER PUBLICATIONS

"Cryopak the Coolest Way to Go", brochure of Cryopak Corporation, Nov., 1995.

Cryopak Corporation Refrigerant Packaging User Manual, 1st ed., Apr., 1996.

"Introducing the Crypak Reusable Ice Substitute", brochure of Cryopak Corporation.

*Primary Examiner*—Amy B. Vanatta
*Attorney, Agent, or Firm*—James C. Simmons

[57] ABSTRACT

In combination with a shirt, one or more pouches which receives a cooling and/or warming pack. The cooling pack comprises sealed compartments containing water or other material which changes state thereby absorbing heat to cool the wearer when the cooling pack is exposed to a predetermined temperature for wearing of the shirt. The warming pack sealingly contains a material which is heatable to store heat and to release the stored heat when the warming pack is exposed to a predetermined temperature for wearing of the shirt. The cooling pack may also be provided as part of a wrist band.

15 Claims, 3 Drawing Sheets

COOLING AND/OR WARMING SHIRT

This application claims the benefit of U.S. Provisional Application No. 60/011,304 filed Feb. 7, 1996 and Provisional Number 60/012,787 filed Mar. 4, 1996.

The present invention relates generally to apparel. More particularly, the present invention relates to shirts.

As people get older, their ability to withstand high temperatures declines. Sustained high temperature conditions may even be critical to their very survival. Yet many older people may not have the financial means to remain sufficiently cool under such conditions.

Joggers may find temperatures approaching 100 degrees F. and more to be too high for jogging comfortably. Such temperatures curtail other outdoor sports activities as well.

Art which depicts various devices for warming or cooling includes U.S. Pat. Nos. 2,566,533; 3,717,145; 4,005,494; 4,641,655; 4,688,572; 4,776,042; 4,805,619; 4,805,620; 5,016,629; 5,069,208; 5,133,348; and 5,424,519. However, none of these devices are suitable for providing a generalized cooling effect over the bodies of joggers, older persons, and others during high temperature conditions or for providing a generalized warming effect over the bodies of persons during cold conditions.

It is accordingly an object of the present invention to provide such cooling to older people, joggers, and others in high temperature conditions.

It is another object of the present invention to provide such a generalized warming effect.

It is a further object of the present invention to provide such a cooling and/or heating effect conveniently.

In order to provide such cooling, in accordance with the present invention, one or more pouches are provided in combination with the shirt, and a cooling pack is provided in each pouch. Each cooling pack comprises one or more sealed compartments containing a material which changes state thereby absorbing heat when the cooling pack is exposed to a predetermined temperature. In order to provide such warming, sealed warming packs are receivable in the pouches. For convenience of the wearer, pouches may be provided on the inner surfaces of the shirt so that the shirt may present an aesthetically-pleasing appearance, and the shirt with the cooling and/or heating packs in the pouches placed in a freezer and/or microwave oven respectively for charging the packs.

The above and other objects, features, and advantages of the present invention will be apparent in the following detailed description of the preferred embodiments thereof when read in conjunction with the accompanying drawings wherein the same reference numerals denote the same or similar parts throughout the several views.

DETAILED DESCRIPTION OF THE PREFERRED EMBODIMENTS

Figure 1:
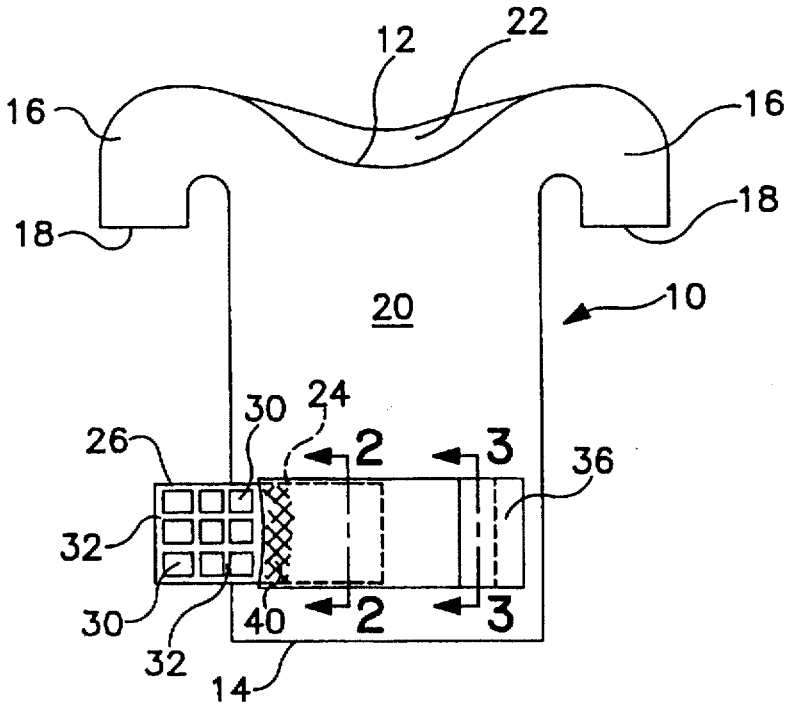
FIG. 1 is a front view of a shirt which embodies the present invention.
Figure 2:
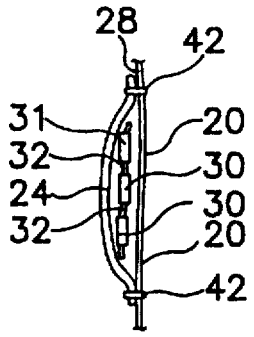
FIGS. 2 and 3 are sectional views thereof taken along lines 2—2 and 3—3 respectively of FIG. 1.
Figure 3:
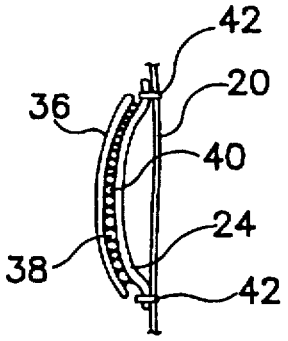

Referring to FIGS. 1 to 4, there is shown generally at 10 a shirt, which may be a T-shirt worn by a jogger on a summer day or any other suitable shirt such as one that buttons down the front. The shirt 10 includes a neck opening 12, a lower opening 14 which generally circumscribes the wearer's waist, and a pair of short sleeves 16 containing arm openings 18. The shirt 10 may alternatively have long sleeves or no sleeves at all. The shirt 10 may be composed of a woven cotton or other suitable natural or synthetic material and may be plain or have designs thereon. The shirt 10 has a front panel 20 for covering the wearer's chest and a back panel 22 for covering the wearer's back. For the purposes of this specification and claims, a "shirt" is defined as any article of apparel constructed to be worn by a person to substantially cover the person's upper torso. For example, the shirt 10 may be a sleeveless button-down vest.

Figure 4:
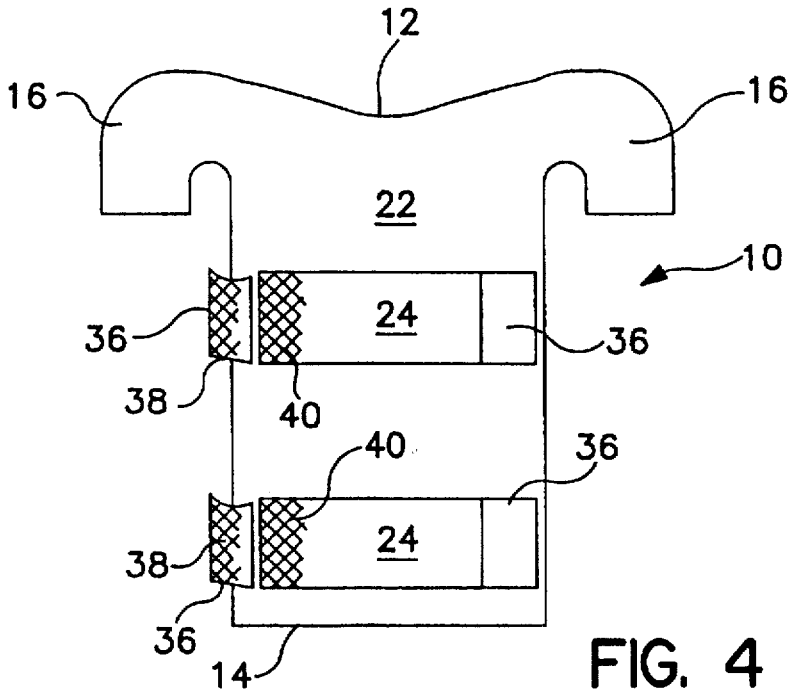
FIG. 4 is a rear view thereof.

In order to cool the wearer of the shirt 10 during hot weather conditions, in accordance with the present invention the shirt 10 is provided on its outer surface 28 with at least one pouch 24 in which a cooling pack 26 is removably placed. FIG. 1 shows a single pouch 24 on the lower portion of the front panel 20, and FIG. 4 shows two pouches 24 on the back panel 22, one on the upper portion and one on the lower portion. The pouches 24 may comprise panels of cloth material sewed to the shirt, as illustrated at 42, to extend substantially over the widths of the respective panels 20 and 22, i.e., perhaps about ¾ of the respective width. For example, for a medium shirt, each pouch may have a length of perhaps about 8 to 10 inches and a height of perhaps about 3 to 5 inches. Since the breast area may be sensitive to women, it may be desired that a pouch not be placed on the upper portion of the front panel 20 especially of a women's shirt, but a pouch may be placed there if desired. The pouches may have other suitable sizes, may be of different sizes, may be of a greater number of smaller size, may extend vertically rather than horizontally, or otherwise suitably sized and positioned to optimize cooling effect over the wearer's torso. However, it is preferred to minimize the number of pouches in order to minimize the number of cooling packs to be used.

The pouches 24 are shown to have openings at both ends thereof. Each opening is closable by a flap 36 having hook and loop-type fasteners such as Velcro fasteners, illustrated at 38 and 40 on the flap 36 and pouch 24 respectively. If desired, a pouch may be provided with only one opening, and the opening may, if desired, be provided at the top edge of the pouch. The openings may be closed by other suitable means, for example, zippers or snaps or buttons.

The cooling pack 26, which is sized to extend over the length and height of the respective pouch to substantially fill the pouch, comprises a plurality of permanently sealed and independent liquid-containing compartments, illustrated at 30, composed from a suitable material such as a synthetic plastic which is relatively thin, flexible, heat-transmissible, and impervious to the liquid. The material is sealed together at spaced intervals both longitudinally and laterally, providing narrow flat seal portions, illustrated at 32, to provide a waffle appearance, as seen in FIG. 1, the seal portions 32 being bendable so as to allow flexibility of the cooling pack. Each of the compartments 30 may be perhaps about ½ to 1¼ inch by about 1 to 2½ inches and have a thickness when the liquid therein is frozen of perhaps about ⅛ to ⅜ inch. The compartments 30 may contain water or other suitable liquid, illustrated at 31, which will absorb heat to change state such as from ice to water under temperatures of 80 to 110 degrees and more at which the shirt may be worn. An example of such a cooling pack is disclosed in connection with bandages and other therapeutical devices in U.S. Pat. No. 2,566,533 to Poux, which patent is hereby incorporated herein by reference. A suitable cooling pack called a Ice Mat pack is contained within a net-like enclosure on an inner wall of a lunch box called the Cool Sack lunch pack sold by Igloo Products Corp. of Houston, Tex. Alternatively, the material 31 may be of a type which changes state from a liquid to a gas at the predetermined temperature range. Suitable cooling packs may, for example, be obtained from Cryopack Corporation of Vancouver, B.C. These packs, which have 6 ml. and 12 ml. compartments, are described in U.S. Pat. No. 4,931,333, which is incorporated herein by reference.

After their insertion in the pouches, the openings at the ends of the pouches should be closed by means of the Velcro fasteners.

When not being used with the shirt, the cooling packs 26 are suitably left in a freezer so as to keep the liquid in the individual compartments 30 frozen, ready instantly for use of the cooling packs. Even when the liquid is frozen, the bendable flat portions 32 allow the cooling packs 26 to remain flexible. In temperatures in the 90's, it is believed the cooling packs 26 may maintain cooling of the wearer's body for more than an hour, long enough for a jogger to remain cool in high temperatures. When a set of cooling packs 26 loses cooling effectiveness, it may be exchanged with another set of cooling packs 26 which has been kept in the freezer while the first set is being used. Of course, the shirt may be worn as an ordinary shirt, i.e., without the cooling packs.

The pouches 24 may be composed of a suitable insulative material such as, for example, polypropylene material. While the material of the shirt 10 will buffer the effects of the cooling packs 26 on the wearer's body, the shirt panels 20 and 22 may be padded with additional material at the locations of the pouches, as desired, in order to optimize comfort as well as cooling effect, using principles commonly known to those of ordinary skill in the art to which this invention pertains. It is believed that the provision of the cooling packs may provide a generalized cooling feeling over the body of the wearer.

Figure 5:
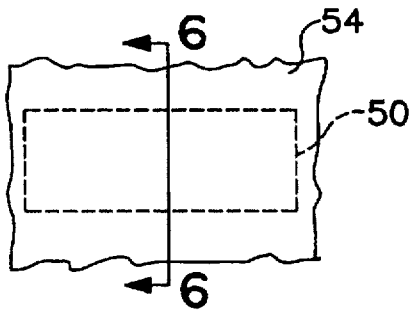
FIG. 5 is a view of a portion of a shirt in accordance with an alternative embodiment of the present invention.
Figure 6:
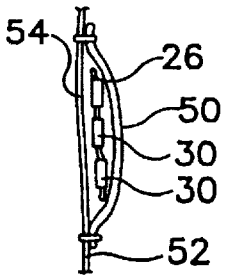
FIG. 6 is a sectional view of the shirt portion of FIG. 5 taken along lines 6—6 thereof.

FIGS. 5 and 6 illustrate the placement of a pouch 50, similar to pouches 24, on the inner surface 52 of a shirt panel 54 in order to provide an enhanced shirt appearance, in accordance with an alternative embodiment of the present invention.

If desired, in order to provide enhanced flexibility for wearer comfort, each of the compartments 30 may contain a mass of heat-exchanging fluid such as a gel or emulsion having a high specific heat. Each of the compartments may also contain a set of cells in a fluid-tight and flexible covering having a mass of thermally active material which presents a change of state when subjected to the range of temperature for use, such as described in U.S. Pat. No. 5,069,208 to Noppel et al, which is hereby incorporated herein by reference. The fluid mass does not change state to a solid at a temperature at which the thermally active material changes to a solid so that the fluid mass remains a fluid when taken from a freezer to be worn by a user. Alternatively, the cooling pack may comprise a single compartment or perhaps 2 or 3 compartments containing the fluid mass in which is dispersed a plurality of cells of the thermally active material.

In accordance with an alternative embodiment of the present invention, it is envisioned that one or more ice packs may be permanently encased or secured in a zip-out lining. In accordance with another alternative embodiment, it is envisioned that one or more ice packs may be permanently encased or secured in a pouch or pouches of the shirt in which event the entire shirt would be placed in a freezer. In this event, the shirt would be worn over an undershirt. For the purposes of this specification and the claims, the term "pouch means" is meant to include a zip-out lining or any other suitable structure for containing one or more of the ice packs.

For use of the shirt for body warming purposes in the winter, suitable warming packs may be substituted for the ice packs. For example, U.S. Pat. No. 5,424,519 to Salee, which is hereby incorporated herein by reference, discloses a seat cushion in which is embedded a thermal storage unit. A microwave-activated thermal storage material is sealingly contained within a cover of the thermal storage unit. Such a thermal storage unit or any other suitable sealed warming pack may be suitably substituted for an ice pack in each pouch of the shirt for warming the body during cold temperatures. Alternatively, the shirt may be provided for receiving only such warming packs.

Suitable wrist bands in which are removably or permanently received sealed ice packs, as described above, may be worn, such as by joggers, to provide a feeling of coolness.

Figure 7:
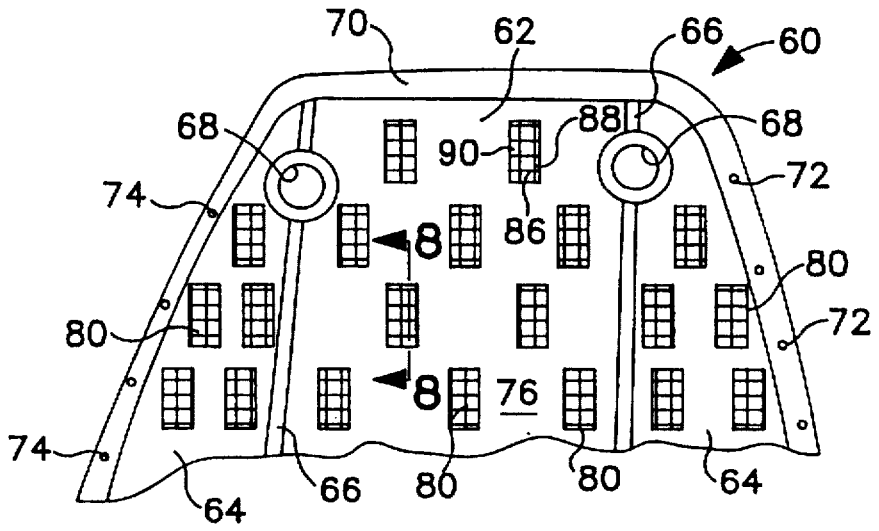
FIG. 7 is a schematic view of a vest, in an unbuttoned condition, in accordance with another alternative embodiment of the present invention.
Figure 8:
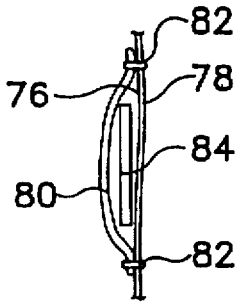
FIG. 8 is a sectional view taken along lines 8—8 of FIG. 7.

Referring to FIGS. 7 and 8, there is illustrated generally at 60 a shirt in the form of a vest in accordance with an alternative embodiment of the present invention. The vest 60 has a back panel 62 and two half front panels 64 joined to the back panel 62 by seams 66 respectively. A pair of arm holes are illustrated at 68. An upper edge for providing an opening for the neck is illustrated at 70. The front panels 64 are joined at their terminal edges by a plurality of buttons 72 on one terminal edge which engage buttonholes 74 on the other terminal edge. The front panels 64 may be joined by other suitable means such as, for example, a zipper. The shirt 60 is thus of a type which opens down the front. The shirt 60 has an inner surface 76 for engaging the wearer's body or undershirt and an outer surface 78.

A plurality of strips 80 of webbed or other suitable material are sewed to the inner surface 76 as illustrated by stitching 82 which extends entirely around the perimeter of each strip 80 to form with the inner surface 76 a closed pouch. The material of which strips 80 is composed is desirably washable. The pouches 80 may be provided on the inner surface 76 so as not to detract from the outer surface appearance so that the shirt may have an aesthetically-pleasing appearance. A cooling pack 84, which may be similar to one of the compartments 30 of a cooling pack 26, is contained within each of the pouches 80.

By webbed material is meant a cloth-like material such as, for example, 12-count needlepoint Aida cloth material, having a plurality of spaced strands, illustrated at 86, extending in one direction and a plurality of spaced strands, illustrated at 88, extending in a direction cross-wise thereto, leaving spaces or voids, illustrated at 90, therebetween for easy transmissibility of the cooling effect of the cooling packs 84. Yet the pouch material offers some insulation from direct contact with the cooling packs 84 to enhance comfort of the wearer. It should, however, be understood that the pouches 80 may be composed of other suitable material which offers suitable transmissibility of the cooling effect.

Figure 9:
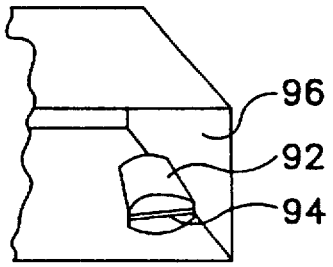
FIG. 9 is a schematic view of a freezer compartment in which the vest of FIG. 7 is placed for freezing the liquid in cooling packs thereof.

FIG. 9 illustrates a bag 92 in which the vest 60 may be placed, the bag 92 having a closable opening 94. For example, the bag 92 may be a zip-lock bag, or the bag 92 may be a plastic bag closed by a twist tie. The bag 92 with the vest 60 contained therein is placed in the freezer compartment 96 of a refrigerator for freezing the liquid in the freezer packs 84 prior to wearing of the vest 60. The bag 92 is provided to segregate the vest 60 from food products. One or more vests 60 may be kept in the freezer 96 while another is being worn. When one has lost its effectiveness, after perhaps an hour of wear, it may then be exchanged with one from the freezer 96 having frozen cooling packs 84.

The vest 60 may be worn over a shirt to enhance comfort or without an undershirt to maximize the cooling effect. The elimination of the necessity to remove and replace cooling packs affords convenience to the wearer.

Instead of cooling packs 84, the pouches 80 may be provided to contain warming packs such as disclosed in the aforesaid Salee patent. This would of course require that the shirt 60 be subjected to microwave energy in a microwave oven to charge the warming packs. Accordingly, the materials of which the shirt 60 and pouches 80 are composed are suitably of types which are microwave transparent and fire retardant, such as materials (for example, nylon) described in the Salee patent for suitably passing and withstanding microwave energy.

Alternatively, the strips 80 may be stitched to the shirt 60 only along three sides and have a closable opening along the upper side so that cooling packs and warming packs may be interchanged in the pouches for summer-wear and winter-wear, respectively. This also allows the shirt 60 to be more easily laundered since the cooling or warming packs may be first removed.

In accordance with an alternative embodiment of the present invention, a single piece of material may be sewed to the inner surface 76 of the vest 60 to provide a plurality or all of the pouches.

Although the invention has been described in detail herein, it should be understood that the invention can be embodied otherwise without department from the principles thereof, and such other embodiments are meant to come within the scope of the present invention as defined in the appended claims.

What is claimed is:

1. In combination with a shirt, at least one cooling pack comprising sealed compartment means containing a material which changes state thereby absorbing heat when said cooling pack is exposed to a predetermined temperature for wearing of the shirt, and means for connecting said at least one cooling pack to said shirt, wherein said compartment means comprises a fluid mass in which are contained a plurality of sealed cells containing said material, said material being of a type which changes state from a solid to a liquid absorbing heat at the predetermined temperature range for wearing of the shirt, said fluid mass being of a type which does not change to a solid at a temperature to which said material is lowered for freezing and maintaining said material frozen, said connecting means comprising at least one pouch means connected to said shirt for removably receiving said at least one cooling pack, said pouch means comprising a panel sewed to the shirt to provide at least one opening thereto and means for closing the opening, said pouch means also being adapted for interchangeably receiving at least one warming pack which sealingly contains a material which is heatable to store heat and to release the stored heat when said warming pack is exposed to a predetermined temperature for wearing of the shirt.

2. A combination according to claim 1 further comprising at least one warming pack which is interchangeable with said at least one cooling pack, said warming pack sealingly containing a material which is heatable to store heat and to release the stored heat when said warming pack is exposed to a predetermined temperature for wearing of the shirt.

3. A combination according to claim 1 wherein said pouch means is composed of an insulative material.

4. A combination according to claim 1 wherein said pouch means is attached to an outer surface of the shirt and is composed of an insulative material.

5. A combination according to claim 1 further comprising means including a flap and further including hook and loop fasteners on said panel and said flap for closing the opening.

6. In combination with a shirt, at least one cooling pack comprising sealed compartment means containing a material which changes state thereby absorbing heat when said cooling pack is exposed to a predetermined temperature for wearing of the shirt, and means for connecting said at least one cooling pack to said shirt, said connecting means comprising at least one pouch means connected to said shirt for removably receiving said at least one cooling pack, wherein said pouch means comprises a panel sewed to the shirt to provide openings at both ends thereof, and means including flaps and further including hook and loop fasteners on said panels and said flaps for closing the openings.

7. A combination according to claim 6 wherein said compartment means comprises a plurality of independent compartments containing said material and separated one from another by sealed portions whereby to allow flexibility of the cooling pack when liquid in the compartments has changed to a solid.

8. A combination according to claim 6 wherein the material in said compartment means is of a type which changes state from a solid to a liquid at the predetermined temperature for wearing of the shirt.

9. A shirt having an inner surface and comprising means defining back and front panel means, means for providing a cooling effect generally over the entirety of said back and front panel means, said cooling effect means comprising means defining a plurality of pouches attached to said inner surface and spaced substantially thereover, and a plurality of cooling packs disposed within said pouches respectively, at least one of said cooling packs comprising sealed compartment means containing a material which changes state thereby absorbing heat when said cooling pack is exposed to a predetermined temperature for wearing of the shirt, wherein at least one of said pouches is composed of a webbed material having a first plurality of parallel strands which are spaced from each other and a second plurality of parallel strands which extend in a direction cross-wise to a direction in which said first plurality of parallel strands extends and which are spaced from each other to thereby define spaces between said first and second pluralities of strands for thermal transmissibility while providing insulation from direct contact with the respective cooling pack.

10. A shirt according to claim 9 wherein at least one of said pouches is sewed to said panel means entirely around the perimeter of said at least one pouch.

11. A shirt according to claim 9 wherein said front panel means includes portions which are detachably attachable to each other so that the shirt opens down the front.

12. A shirt according to claim 9 wherein said pouches have means defining closable openings whereby warming packs may be interchanged with said cooling packs.

13. A shirt having an inner surface and comprising means defining back and front panel means, means for providing a warming effect generally over the entirety of said back and front panel means, said warming effect means comprising means defining a plurality of pouches attached to said inner surface and spaced substantially thereover, and a plurality of warming packs disposed within said pouches respectively, said warming packs sealingly containing a material which is heatable to store heat and to release the stored heat when said warming packs respectively are exposed to a predetermined temperature for wearing of the shirt, wherein at least one of said pouches is composed of a webbed material having a first plurality of parallel strands which are spaced from each other and a second plurality of parallel strands which extend in a direction crosswise to a direction in which said first plurality of parallel strands extends and which are spaced from each other to thereby define spaces between said first and second pluralities of strands for thermal transmissibility while providing insulation from direct contact with the respective warming pack.

14. A shirt according to claim 13 wherein at least one of said pouches is sewed to said panel means entirely around the perimeter of said at least one pouch.

15. A shirt according to claim 13 wherein said front panel means includes portions which are detachably attachable to each other so that the shirt opens down the front.

* * * * *